United States Patent [19]

Legierse et al.

[11] Patent Number: 4,931,147

[45] Date of Patent: Jun. 5, 1990

[54] METHOD OF MANUFACTURING A METAL MATRIX

[75] Inventors: Petrus E. J. Legierse; Gustaaf H. A. van der Hoorn, both of Eindhoven, Netherlands

[73] Assignee: U.S. Philips Corporation, New York, N.Y.

[21] Appl. No.: 400,257

[22] Filed: Aug. 29, 1989

[30] Foreign Application Priority Data

Sep. 8, 1988 [NL] Netherlands ..... 8802211

[51] Int. Cl.[5] ..... C23C 18/18

[52] U.S. Cl. ..... 204/5; 204/30

[58] Field of Search ..... 204/5, 30

[56] References Cited

U.S. PATENT DOCUMENTS 3,094,430 6/1963 Skwierinski ..... 117/35

*Primary Examiner*—John F. Niebling
*Assistant Examiner*—William T. Leader
*Attorney, Agent, or Firm*—Norman N. Spain

[57] ABSTRACT

A method of manufacturing a metal matrix which is suitable for the production of synthetic resin information disks, in which a master disk consisting of a glass supporting plate (1) and a photoresist layer (2) comprising an information track is coated with an electroless Ni-layer (6) and an electrodeposited Ni-layer (7). A matrix having an excellent surface quality is obtained by a pre-treatment of the master disk with a detergent and an aminosilane.

4 Claims, 1 Drawing Sheet

METHOD OF MANUFACTURING A METAL MATRIX

The invention relates to a method of manufacturing a metal matrix which comprises an information track on at least one side, in which a master disk comprising a photoresist layer in which an information track has been provide on the side of the photoresist layer is provided in an electroless nickel-plating bath with a nickel layer on which a metal layer is provided by electrodeposition and the resulting metal shell in which the information track of the photoresist layer has been copied, is separated from the master disk.

The metal shell comprises the electrodeposited metal layer and the electroless-deposited nickel layer bonded thereto and comprises the negative copy of the information track of the master disk. This first negative copy in metal is termed father matrix and may serve as a matrix for the production of synthetic resin information disks. Usually, further metal matrices are derived from the father matrix by electrodeposition.

The synthetic resin information disks which are manufactured by means of the metal matrices, are synthetic resin disks having an optically readable information track which comprises video and/or audio information. On the side of the information track the disk is coated with a reflection layer, for example, a layer of Ag or Al. These synthetic resin disks are known by the names of Laser Vision and Compact Disc. The information track of such matrices and synthetic resin disks has a crenellated profile of information areas situated at a higher and at a lower level. The areas are read in reflection by means of laser light. The difference in height between the areas is 0.05–0.2 $\mu$m and the longitudinal dimensions vary between 0.3 and 3 $\mu$m. Another type of disk is a data storage disk. Information bits are formed in the said disk by exposure to pulsated laser light. These disks comprise a recording layer of, for example, a dye, a layer of metal, for example, Bi or a Te-Se alloy. the recording disks comprise a servo track which may comprise optically readable information.

The master disk consists of a flat polished glass plate which comprises on one side a layer of a photoresist which usually is positively active. An example of a suitable photoresist is a resist on the basis of novolak and orthonaphtoquinone diazide. The photoresist layer is modulated, for example, with laser light in the form of a pattern, as a result of which the exposed parts become soluble in a basic solution of, for example, NaOH in water. In order to improve the bonding between the glass plate and the photoresist, a bonding layer is provided on the glass plate before the photoresist layer is provided. A suitable bonding layer is, for example, titanium acetyl acetonate.

The synthetic resin information disks are manufactured by means of the metal matrices by means of injection-moulding, compression or UV polymerisation. Conventionally used synthetic resins are polymethylmethacrylate, polycarbonate and UV-polymerisable (meth)acrylate monomer mixtures.

A method of the type mentioned in the opening paragraph is disclosed in U.S. Pat. No. 4,650,735. In said Specification is mentioned the use of an electroless nickel-plating bath for providing the conductive layer on the photoresist layer. As an alternative possibility for a conductive layer is mentioned the vapourdeposition or electroless deposition of Ag. Such a conductive metal layer is necessary for the electrodeposition thereon of a thick metal shell. The said metal shell is usually of nickel and is electrodeposited from a nickel-plating bath.

A disadvantage of Ag as a conductive layer is that the said metal is soft and hence is subject easily to damage and moreover is rapidly corroded in $SO_2$ or $H_2S$-containing ambient air. Electroless Ni as a conductive layer has for its advantage that it is harder and is better resistant to detrition than Ag and is even harder than electrodeposited Ni. The hardness and resistance to detrition of electroless Ni is caused by the presence of B or P in the deposited Ni, originating from the reducing agent used of the electroless Ni-bath, namely dimethylaminoborane and sodium hypophosphite, respectively. The electroless deposited Ni is very suitable for growing an Ni-layer thereon by electrodeposition. The said U.S. Pat. No. 4,650,735 does not state how electroless Ni can be provided on the master disk with sufficient bonding strength. The surface of the master disk to be nickel-plated consists of different materials, namely photoresist and glass. The glass is present in those sites which are exposed to the laser light and are dissolved by the basic developer, in other words, on the bottom of the information track. Remaining bonding agent, for example, titanium acetyl acetonate, may also be present.

In order to be able to electroless nickel-plate such a varied surface with a sufficiently bonding Ni-layer, the surfaces to be nickel-plated should comprise sufficient hydroxyl groups. These hydroxyl groups are necessary for the adsorption of $Sn^{2+}$-ions originating from the conventionally used sensitiser solution. The said adsorbed $Sn^{2+}$-ions are then exchanged with $Pd^{2+}$-ions originating from the conventionally used nucleating solution, adsorbed Pd-metal nuclei and $Sn^{4+}$-ions being formed. Nickel is deposited in an electroless Ni-bath on surfaces comprising adsorbed Pd-nuclei, the $Ni^{2+}$-ions present being reduced to Ni-metal and the reducing agent present being oxidised. Instead of these solutions comprising tin and palladium ions, colloidal tin-palladium solutions may also be used, for example, Cataposit PM-958 of Shipley. A conventionally used method of providing hydroxyl groups is, for example, a pre-treated with chromic acid - sulphuric acid. This method is too agressive for the present surface, as a result of which the fineness of the information track is lost. Other known pre-treatment methods for glass and sythetic resins are corona and UV-ozone treatments. In these treatments the surface is exposed to short-wave UV-light of approximately 200 nm. However, this short-wave UV-light causes a further polymerisation of the photoresist layer, as a result of which the photoresist layer becomes insoluble and residues of the photoresist layer which in the separation of the father matrix from the master disk remain on the former, cannot be removed any longer.

One of the objects of the invention is to provide a method of the type mentioned in the opening paragraph which obviates the disadvantages mentioned hereinbefore.

According to the invention, this object is achieved by means of a method as described in the opening paragraph which is chatacterised in that, before the electroless nickel layer is provided, the surfaces to be nickel-plated are treated successively with a detergent and a solution of aminosilane. It has been found that detergents cause sufficient hydroxyl groups on the photoresist layer and the glass surface, in which the fineness of the information track is maintained. A suitable aminosilane is, for example, N-beta-aminoethylaminopropyl trimethoxysilane which is known under the tradename Silaan A1120 of union Carbide Corp.. other aminosilanes may also be used.

An embodiment of the method according to the invention is characterised in that sodium lauryl sulphate is used as a detergent.

A preferred embodiment of the method according to the invention is characterised in that the electroless nickel-plating bath comprises sodium benzene disulphonate. Electrodeposited or electroless deposited metal layers generally show tensile stresses. As a result of the said tensile stresses the metal layer may work loose from the substratum and/or undesired crackle structure is formed in the metal layer. It will be obvious that this is disastrous for the manufacture of the metal matrices having a very fine information pattern. It has been found surprisingly that the addition of appoximately 1 g/l of sodium benzene disulphonate to the electoless nickel-plating bath causes the internal stresses in the deposited nickel layer to be reduced considerably so that delamination and crackle phenomena no longer occur. The sodium benzene disulphonate has no detrimental influence on the electroless nickel-plating process, such as reduced deposition rate or reduced hardness and resistance to detrition of the deposited nickel.

An embodiment of the method according to the invention is charaterised in that, after the treament with aminosilane, the surfaces to be nickel-plated are treated with tannin. Tannin, also known as tannic acid, is a pentagallolyl glucose compound. The substance is used in the form of an aqueous solution. The substance may optionally comprise water-miscible organic solvents, for example, an alcohol. The concentration of tannin may be chosen between wide limits and is, for example, from 0.01 to 10 g per liter. Such a treatment with tannin does not make the said pre-treatment with aminosilane superfluous, but it does have a favourable effect on the bonding of the nickel layer.

The pre-treatment solutions for the electroless nickel-plating process may be sprayed, nebulished, poured, etc., on the surface of the master disk. Dipping the master disk in the various solutions is also possible. These methods may also be used for the electroless nickel-plating process.

The invention will now be described in greater detail with reference to the ensuring specific example and the accompanying figures, in which.

SPECIFIC EXAMPLE

Figure 1:
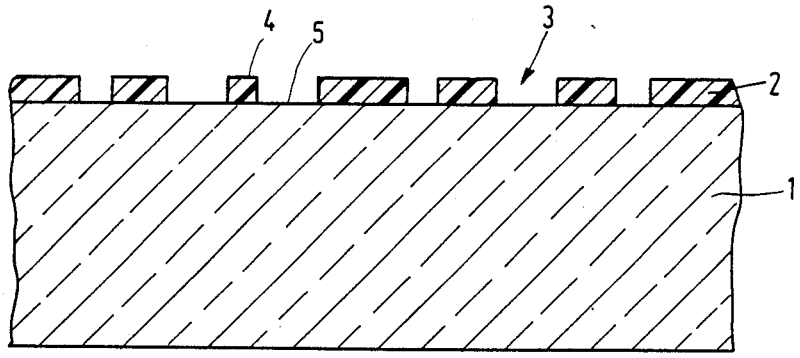
FIG. 1 is a diagrammatic sectional view of a master disk.

Reference numeral 1 in FIG. 1 denotes a 5 mm thick glass plate having a diameter of 240 mm. The glass plate is provided on one side with a bonding layer of titanium acetyl acetonate (not shown). The said bonding layer is provided by means of spraying of a 0.5% solution of a mixture of titanium acetyl acetonate - isopropanol in methyl butyl ketone, after which the solvent is evaporated.

A photoresist layer 2 is then provided on the bonding layer and after drying has a thickness of 0.12 μm. The positive photoresist used is novolak having orthonaphtoquinone diazide as a photosensitive substance. The resist layer is exposed to pulsated laser light (wavelength 458 nm) which modulated in accordance with the information to be recorded. The resist layer thus exposed in the form of a pattern is developed with solution of 10 g of NaOH and 50.5 g of $Na_4P_2O_7.10H_2O$ in 4.5 l of water. As a result of this the exposed parts of the photoresist layer are dissolved and a spiral-like information track 3 is formed which has a crenellated profile of information areas 4 situated at a higher level alternated by information areas 5 situated at a lower level. The longitudinal dimensions of the areas vary from approximately 0.3 to 3 μm in accordance with the stored information. The difference in height between the information areas is approximately 0.1 μm. The master disk is then dipped in a solution of 0.1 g of sodium lauryl sulphate per liter of water for 5 minutes. Rinsing is then carried out with deionised water for 1 minute. The solutions hereinafter are used for the following treatments:

AMINOSILANE SOLUTION 4 ml of Silane A1120 (product of Union Carbide Corp.) are dissolved in 400 ml of deionised water.

TANNIN SOLUTION 1.2 g tannin are dissolved in 400 ml of deionised water.

$Sn^{2+}$ SOLUTION

5 μl of an RNA solution (product of London Laboratories Ltd.) are dissolved in 400 ml of deionised water.

$Ag^+$ SOLUTION 0.8 ml of an MS-IL solution (product of London Laboratories Ltd.) are dissolved in 400 ml of deionised water.

$Pd^{2+}$ SOLUTION 100 mg of $PdCl_2$ are dissolved in 3.5 ml of concentrated hydrochloric acid. The solution is made up to 1 liter by means of deionised water.

The photoresist side of the master disk is provided with the above-mentioned pre-treating solutions by pouring in the sequence hereinafter, rinsing with deionised water being carried out for 1 minute after each pre-treating step.

Aminosilane solution: 3 minutes
Tannin solution: 1 minute
$Sn^{2+}$ solution: 1.5 minutes
$Ag^+$ solution: 1 minute
$Pd^{2+}$ solution: 1.25 minutes.

The master disk thus pre-treated is then nickel-plated in an electorless nickel-plating bath. For that purpose the following solutions were prepared:

STOCK SOLUTION A $NiSO_4.6H_2O$: 50 g
$Na_4P_2O_7.10H_2O$: 100 g
deionised water: 950 ml The resulting solution is brought at a pH of 9.4 by means of concentrated ammonia. The solution is then made up to 1 liter with deionised water.

STOCK SOLUTION B dimethylaminoborane: 3 g
deionised water: 1 liter

Figure 2:
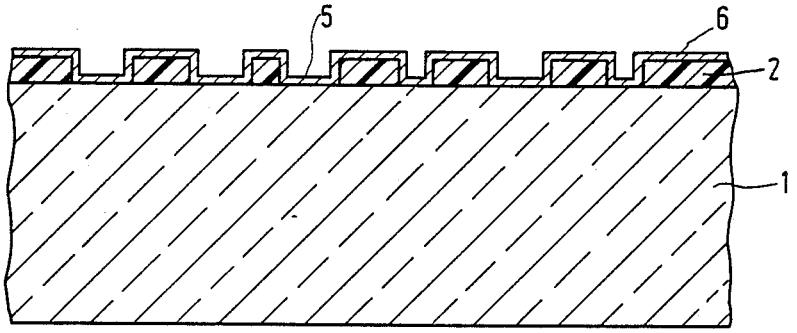
FIG. 2 is a diagrammatic sectional view of a master disk having an electroless deposited nickel layer.

Equal volumes of stock solutions A and B are combined. The formed solution is brought to a pH of 9.2 by means of an aqueous $H_2SO_4$ (50% by weight) solution. 1.110 g of sodium benzene disulphonate are then dissolved in the said solution. The temperature of the solution is raised to 45° C. 400 ml of the last-mentioned solution are poured on the photoresist side of the pretreated master disk. After approximately 30 minutes a 100 nm thick Ni-layer 6 (see FIG. 2) has been deposited on the photoresist layer and on the glass surface 5. The Ni-layer comprises a few percent. by weight of solution B originating from the reduction agent dimethylaminoborane.

Figure 3:
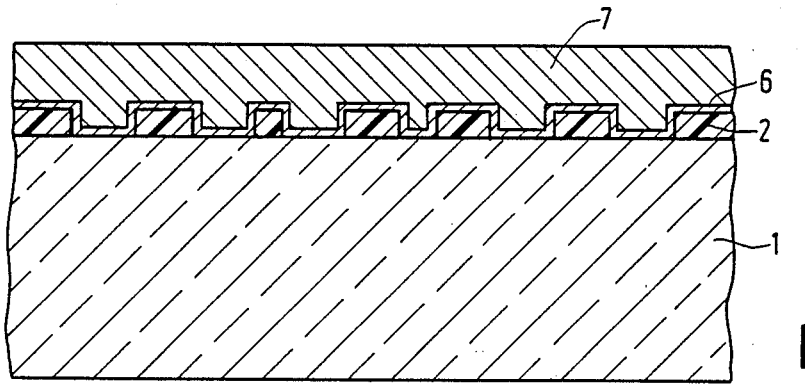
FIG. 3 is a diagrammatic sectional view of a master disk having an electroless deposited nickel layer and an electrodeposited metal layer.

A nickel layer 7 (see FIG. 3) is electrodeposited on the Ni-layer 6 in a thickness of 300 μm. The electroless Ni-layer is connected as cathode in a bath having, for example, the following composition:

Nickel sulphamate: 450 g/l
$NiCl_2.2H_2O$: 5 g/l
Boric acid: 45 g/l

The temperature of the bath is 45° C. and the pH has a value of 4.0. The Ni-layer is deposited with a current density of approximately 15 A/dm$^2$.

Figure 4:
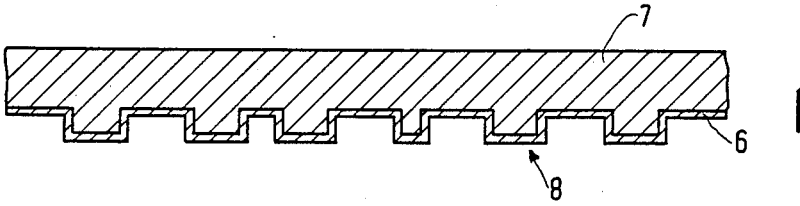
FIG. 4 is a diagrammatic sectional view of a father matrix.

The metal shell consisting of the Ni-layer 7 and the electroless Ni-layer 6 bonded thereto is pulled from the photoresist layer 2 (see FIG. 4). The information track 8 present in the metal shell is a negative copy of the information track 1 (FIG. 1). The negative copy is termed father matrix. Residues, if any, of the photoresist layer remaining on the father matrix can be removed by means of the developer solution already mentioned, if the photoresist layer, after developing the parts exposed in the form of a pattern, is exposed completely with, for example, a 500 W super high pressure Hg-lamp for 4 minutes. Usually a metal copy (mother matrix) is manufactured from the father matrix by passivating the surface of the nickel layer 6 by a treatment with an aqueous solution of $K_2Cr_2O_7$ and then electrodepositing an Ni-layer on the side of the information track 8. After separating the last mentioned Ni-layer from Ni-layer 6, 7, the mother matrix is obtained. From this mother matrix, son matrices can be manufactured by electrodeposition in the same manner as stated hereinbefore. Synthetic resin information carries are manufactured by means of the son matrices by using, for example, an injection-molding process. Both the father matrix, the mother matrix, the son matrix and the synthetic resin information carries have an excellent surface quality.

We claim:

1. A method of manufacturing a metal matrix which comprises an information track on at least one side, in which a master disk comprising a photoresist layer in which an information track has been provided on the side of the photoresist layer is provided in an electroless nickel-plating bath with a nickel layer on which a metal layer is electrodeposited and the resulting metal shell in which the information track of the photoresist layer has been copied, is separated from the master disk, characterised in that, before the electroless nickel layer is provided, the surfaces to be nickel-plated are treated successively with a detergent and solution of aminosilane.

2. A method as claimed in claim 1, characterised in that the detergent used is sodium lauryl sulphate.

3. A method as claimed in claim 1, characterised in that the electroless nickel-plating bath comprises sodium benzene disulphonate.

4. A method as claimed in claim 1, characterised in that, after the treatment with aminosilane, the surfaces to be nickel-plated are treated with tannin.

* * * * *